US006796085B2

(12) United States Patent
Smith

(10) Patent No.: US 6,796,085 B2
(45) Date of Patent: Sep. 28, 2004

(54) WINDOW REGULATOR

(76) Inventor: Peter J. Smith, 263 Park Avenue, Newmarket, Ontario (CA), L3Y 1V3

( * ) Notice: Subject to any disclaimer, the term of this patent is extended or adjusted under 35 U.S.C. 154(b) by 0 days.

(21) Appl. No.: 10/350,098

(22) Filed: Jan. 24, 2003

(65) Prior Publication Data

US 2004/0144032 A1 Jul. 29, 2004

(51) Int. Cl.[7] ..... E05F 11/48
(52) U.S. Cl. ..... 49/352; 49/349
(58) Field of Search ..... 49/352, 349, 348, 49/502, 358

(56) References Cited

U.S. PATENT DOCUMENTS 1,109,574 A * 9/1914 Gates ..... 49/352
1,457,316 A * 6/1923 Price ..... 49/352
4,785,582 A * 11/1988 Tokue et al. ..... 49/211
4,819,377 A * 4/1989 Bauer et al. ..... 49/221
4,829,711 A * 5/1989 Sambor ..... 49/211
4,970,827 A * 11/1990 Djordjevic ..... 49/349
5,022,184 A * 6/1991 Yamamura et al. ..... 49/352
5,058,322 A * 10/1991 Sambor ..... 49/352
5,263,282 A * 11/1993 Cooper et al. ..... 49/348
5,528,861 A * 6/1996 Beyerlein ..... 49/352
5,685,111 A * 11/1997 Zimmerer et al. ..... 49/352

OTHER PUBLICATIONS

Marshal Brain, How a Block and Tackle Works, How Stuff Works.

* cited by examiner

*Primary Examiner*—Gregory J. Strimbu

(57) ABSTRACT

A window regulator, e.g., for a vehicle window, which includes opposing block and pulley arrangements that interact via a lift pulley (36) mounted to a lift plate (16) that slides along a rail (22). Operative movement of a crank assembly (44) in a first sense tensions a cable (32*a*) to move the lift plate (16) toward a first end (34*a*) of the rail (22), and operative movement of the crank assembly (44) in a second sense, opposite the first sense, tensions a cable (32*b*) to move the lift plate (16) towards a second end (34*b*) of the rail (22). The regulator enables the reduction of the operating torque requirements without effecting the packaging of the crank assembly.

15 Claims, 4 Drawing Sheets

WINDOW REGULATOR

FIELD OF INVENTION

The invention generally relates to the field of window regulators, and more particularly to window regulators for automotive applications.

BACKGROUND OF INVENTION

One of the designs objectives for window regulating systems, particularly in automotive applications where the regulator controls the vehicle window, is to optimize the operating torque by maximizing the number of crank turns to the limit provided for by specification. In automotive applications, the maximum number of permissible crank turns is generally limited in manual applications to about 6–6.5 turns. Reducing the operating torque reduces the amount of power or manual effort required to raise the window.

Conventionally, operating torque can be reduced by reducing the diameter of the drum which connects the crank to the cable(s) attached to the lift plate. The problem with this solution is that the cable is subject to higher stress because it is wrapped around a smaller diameter. In addition, decreasing the diameter of the drum will increase the number of turns, resulting in a wider drum. This could result in packaging problems since the width of the drum and drum housing must fit within a confined space defined between the inner and outer panels of a vehicle door. In addition, increasing the number of drum turns increases the possibility of ratcheting (i.e., noise) resulting from the cable rubbing against the walls of the grooves in the drum, particularly since the cable is routed at a greater angle between its intake position entering the drum housing and the outermost turns of the drum.

An alternative approach to reducing operating torque is to employ a gear reduction system in the drum housing. The problem with this solution is that the extraneous gears typically increase the width of the drum housing, leading to the packaging constraints discussed above. Another problem with gear reduction systems is that they typically require tight tolerances, driving up costs, and backlash is a persistent problem in such systems.

A alternative solution of preferably low cost is desired in order to optimize torque in window regulating systems.

SUMMARY OF INVENTION

In general, the invention employs a pulley 'block and tackle' principle in order to obtain a mechanical advantage for reducing operating torque requirements.

According to one aspect of the invention, there is provided a window regulator assembly. The window regulator has a rail on which a lift plate is mounted to slide therealong. The lift plate is configured to mountingly receive a window thereto. A lift pulley is rotatably mounted on the lift plate. A first guide pulley and a second guide pulley are respectively mounted near first and second ends of the rail. The assembly has at least one cable that has a first end anchored near the first end of the rail and wound about the lift pulley and thence routed about the first guide pulley to operatively engage a crank assembly, and a second end anchored near the second end of the rail and wound about the lift pulley and thence routed about the second guide pulley to operatively engage the crank assembly. Operative movement of the crank assembly in a first sense tensions the at least one cable to move the lift plate towards the first end of the rail, and operative movement of the crank assembly in a second sense, opposite the first sense, tensions the at least one cable to move the lift plate towards the second end of the rail.

The preferred embodiment employs first and second cables. The first cable is fixed near the first end of the rail, thence wound around the lift pulley to the first guide pulley, and thence routed to the crank assembly. The second cable is fixed near the second end of the rail, thence wound around the lift pulley to the second guide pulley, and thence routed to the crank assembly. The crank assembly preferably includes a multi-turn cable-guiding drum, the first and second cables being anchored to the drum and disposed to wind around the drum.

BRIEF DESCRIPTION OF DRAWINGS

The foregoing and other aspects of the invention will become more apparent from the following description of illustrative embodiments thereof and the accompanying drawings, which illustrate, by way of example, the principles of the invention. In the drawings.

DETAILED DESCRIPTION OF PREFERRED EMBODIMENTS

Figure 1:
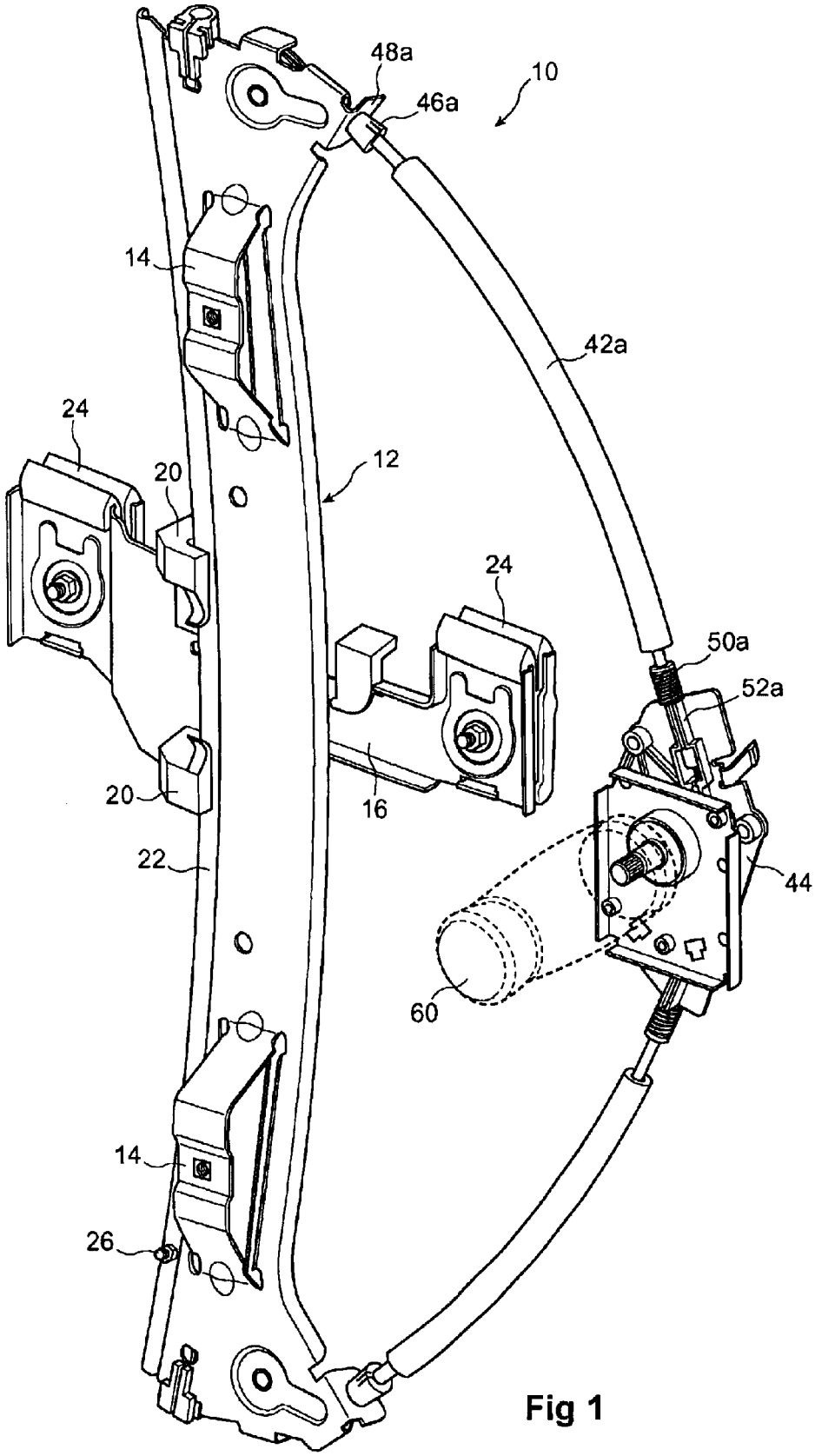
FIG. 1 is a perspective view of a window regulator according to the preferred embodiment from one side of the device.
Figures 2, 2B:
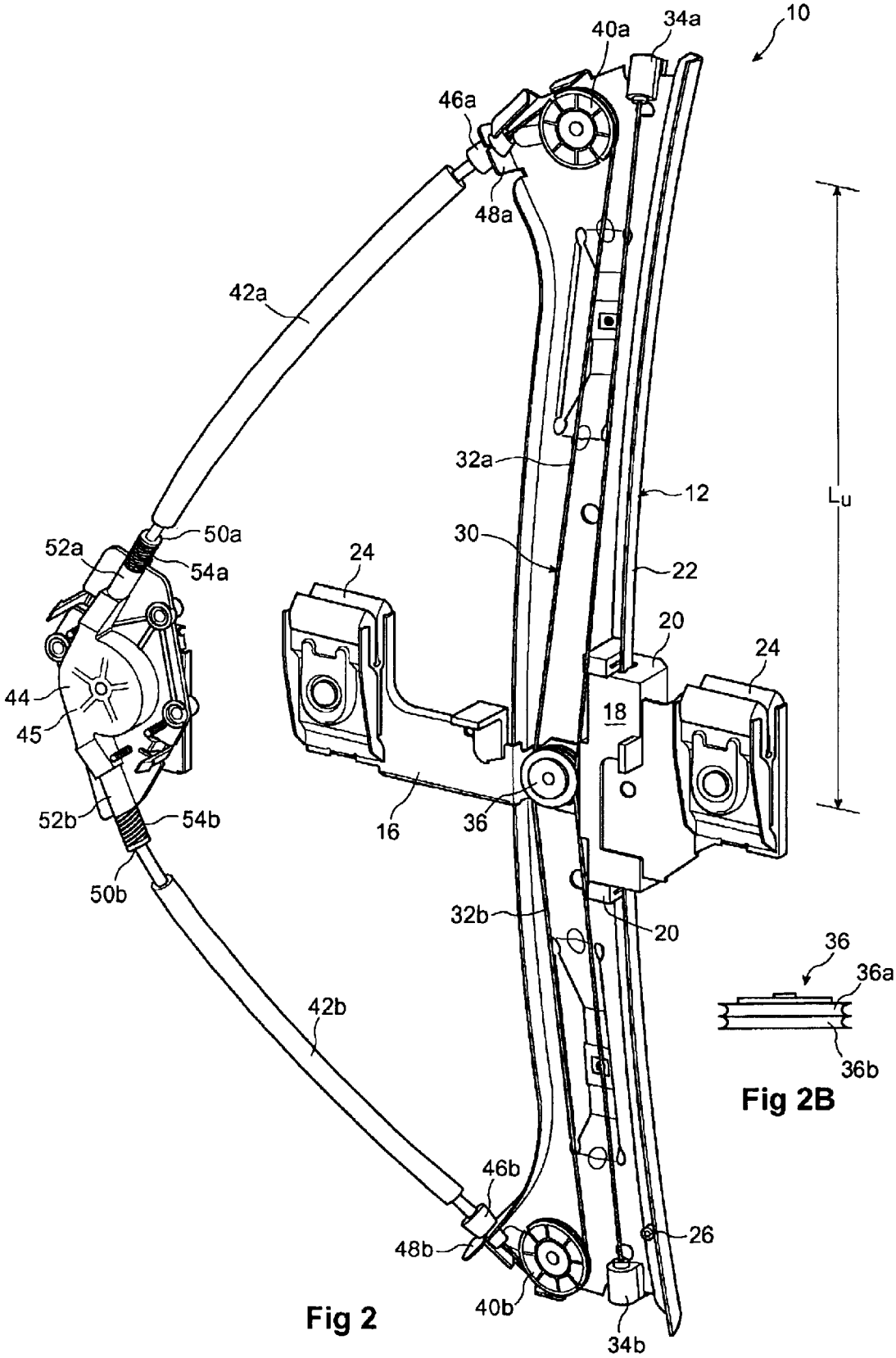
FIG. 2 is a perspective view of the window regulator according to the preferred embodiment from an opposite side of the device.
FIG. 2B is an view of a lift pulley.

FIGS. 1–2 show a window regulator 10 according to the preferred embodiment. The regulator 10 comprises a rail assembly 12 which is mountable to the vehicle door structure via integrally formed brackets 14. A lift plate 16 including a plastic guide 18 is mounted to the rail assembly 12. More particularly, the guide 18 includes slotted tabs 20 which slidingly ride along flanges 22 formed along the edges of the rail assembly 12. The lift plate 16 includes rubber-tipped clamps 24 for mounting the vehicle window (not shown) thereto and those skilled in the art will appreciate that a variety of other methods are known of securing glass to the lift plate, any of which may be used. Stop 26 defines the lower limit of travel for the lift plate 16 and the vehicle window frame (not shown) functions an an upper limit of travel, and hence the maximum distance that can be traversed by the vehicle window.

Figure 3:
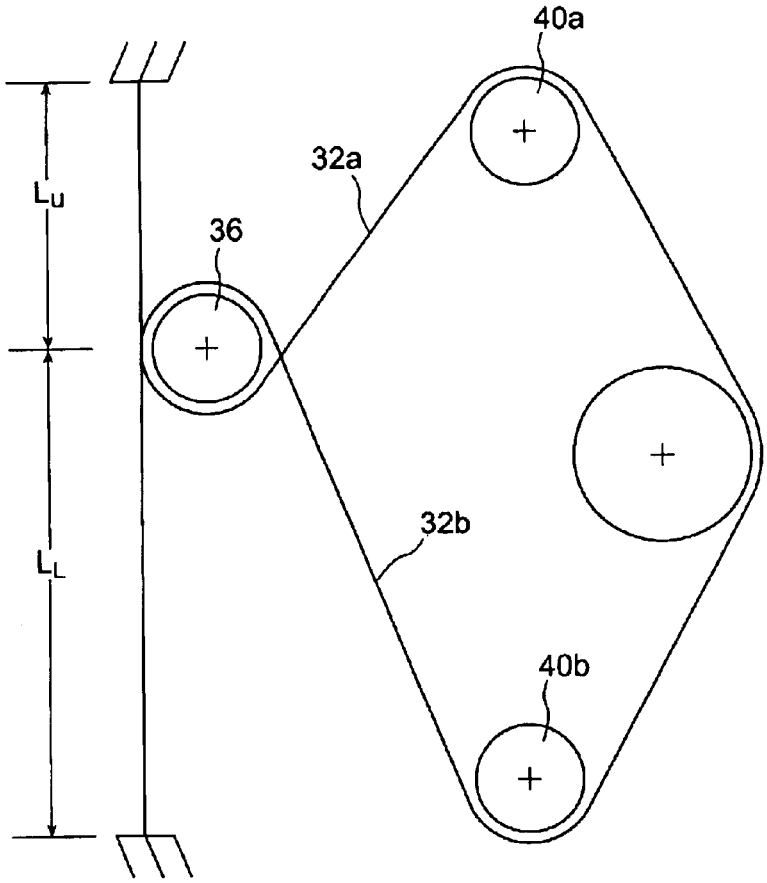
FIG. 3 is a schematic diagram of a pulley system, shown in isolation, which is employed in the window regulator of the preferred embodiment to provide a 2:1 mechanical advantage.
Figure 5A:
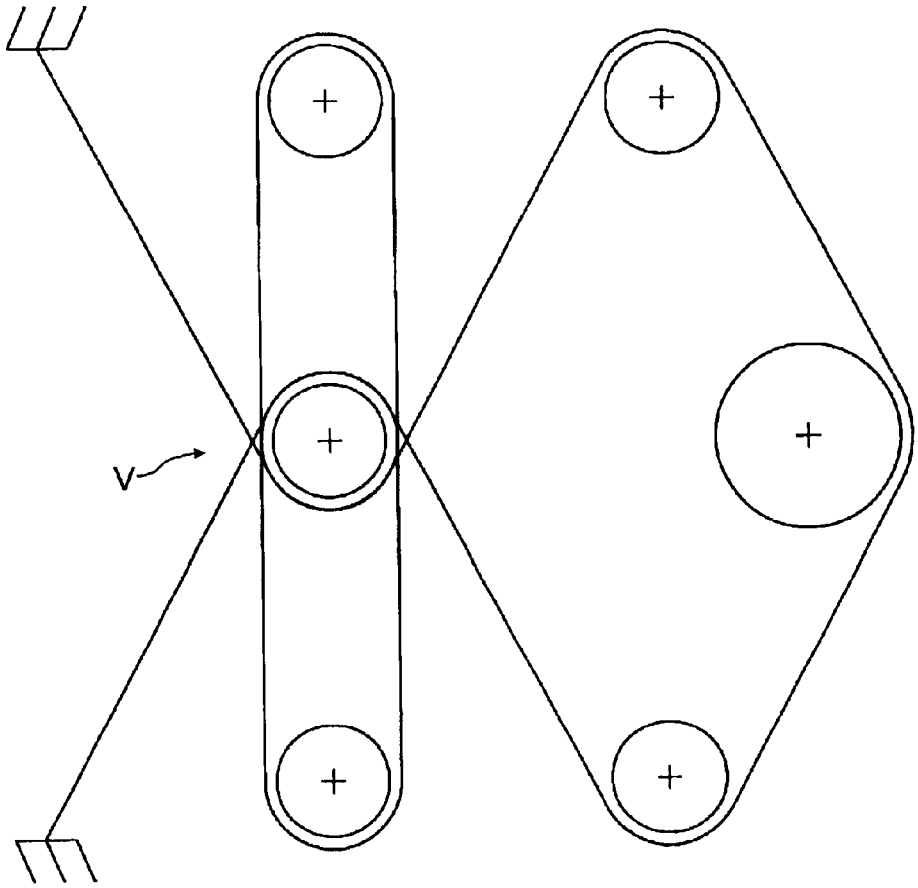
FIG. 5A is a schematic diagram of a pulley system, shown in isolation, which is employed in the window regulator of another embodiment.
Figure 5B:
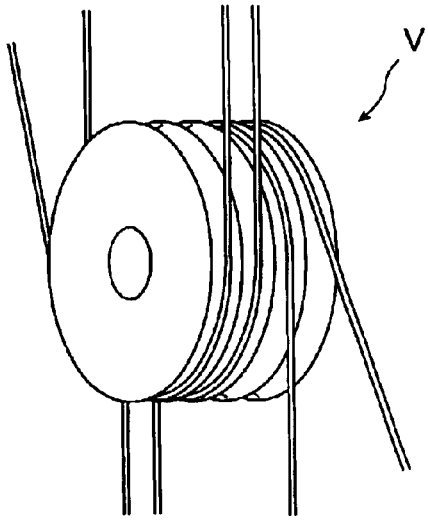
FIG. 5B is an isolated view of a cable-winding drum of the FIG. 5A embodiment.

The lift plate 16 is regulated by a pulley system 30, shown in isolation in FIG. 3, which comprises an upper cable 32*a* and a lower cable 32*b*. The upper cable 32*a* is anchored to the top of the rail assembly 12 by an anchor 34*a*. The upper cable 32*a* is routed around a pulley rivet or lift pulley 36. The lift pulley 36 is preferably rotatably mounted to the lift plate 16 and features two independent (i.e., non-spiraling) grooves 36*a*, 36*b* (see detail at FIG. 2B). The upper cable

32*a* is routed around one of the grooves 36*a,* 36*b* and back up to an upper guide pulley 40*a* which is rotatably mounted to the top of the rail assembly 20. From the guide pulley 40*a* the upper cable 32*a* is routed through a first conduit 42*a* and attached to a crank assembly 44. The crank assembly 44 includes a multi-turn cable-guiding drum 445 (not explicitly shown in FIGS. 1 & 2) as well known in the art per se which is mount d in the housing 45 of the assembly 44. The upper cable 32*a* is anchored to the drum and, depending on whether or not the limit of travel has been reached, partially wound around the drum.

The conduit 42*a* is mounted to the rail assembly 12 by a conduit socket 46*a* mounted in a receptacle 48*a* formed in the rail assembly. Another conduit socket 50*a* is mounted to an intake tube 52*a* of the housing 45, and a cable tension spring 54*a* is provided to maintain tension on the upper cable 32*a.*

The lower cable 32*b* is muted in a similar manner. The lower cable 32*b* is anchored to the bottom of the rail assembly 12 by an anchor 34*b* and routed around the other of the grooves 36*a,* 36*b* of the lift pulley 36. From the lift pulley 36 the lower cable 32*b* is routed around back down to lower guide pulley 40*b* which is fixed to the bottom of the rail assembly 20. From the guide pulley 40*b* the lower cable 32*b* is routed through a second conduit 42*b* and attached to the multi-turn cable-guiding drum of the crank assembly 44.

These second conduit 42*b* is mounted to the rail assembly 12 by a second conduit socket 46*b* mounted in a second receptacle 48*b* formed in the rail assembly. A second conduit socket 50*b* is mounted to a second intake tube 52*b* of the housing 45, and a second cable tension spring 54*b* is provided to maintain tension on the lower cable 32*b.*

Figure 4:
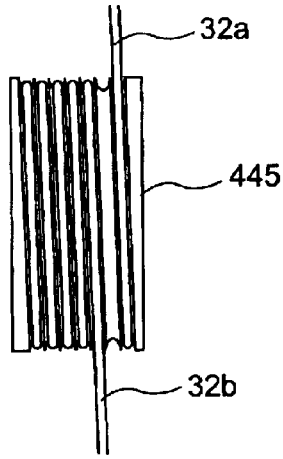
FIG. 4 is an isolated view of a cable-winding drum.

A handle 60 (shown in phantom) is attached to the crank assembly 44. Rotating the handle 60 causes the cable-guiding drum 445, shown in isolation in FIG. 4, to rotate. The drum 445 converts rotational motion to linear motion so as the drum 445 rotates, the cables 32*a,* 32*b* which are wound around the drum, are translated. More particularly, as the drum 445 rotates, one of the upper and lower cables 32*a,* 32*b* spools onto the drum while the other cable correspondingly spools off the drum, i.e., one cable winds onto the drum while another cable winds off the drum.

As the drum rotates, the length $L_u$ of one of the cables 32*a,* 32*b* as measured along the rail flange 22 increases with a corresponding decrease in the length $L_l$ of the other cable as measured along the rail flange. In conjunction, the lift pulley 36 travels up or down depending on which cable increases its length along the rail. Note that as a result of the pulley system, the lift pulley 36, and hence the vehicle window, travels at substantially half the speed of the cables, yielding a 2:1 mechanical advantage and thus a 2:1 reduction in motive torque requirements. This is shown also in the exaggerated schematic diagram of FIG. 3.

It is desirable to have both upper and lower cables 32*a,* 32*b* wrapped around the lift pulley 36 from opposing directions in a symmetrical arrangement. Note that one of the cables, e.g., cable 32*a,* is routed in a 'block and tackle' arrangement and, being under tension, presents a force acting upwards on the lift pulley 36 and lift plate 16. The other cable, e.g., cable 32*b,* is also routed in a block and tackle arrangement and, being under tension, presents a force acting downwardly on the lift pulley 36 and lift plate 16. The upward and downward forces are preferably selected so as to be substantially equal by the use of a counterbalance spring in the drum housing.

It will be understood that while the preferred embodiment employed two cables, a single cable could be wound around the drum and used to translate the lift pulley. In addition, while the preferred embodiment has shown a manually activated crank assembly, it will be understood that a motor or other electromechanical actuator can alternatively provide the motive torque for actuating the regulator. Those skilled in the art will appreciate that a variety of other modifications may be made to the embodiments disclosed herein without departing from the spirit of the invention.

What is claimed is:

1. A window regulator assembly comprising:

a rail, a lift plate mounted on the rail to slide therealong, the lift plate configured to mountingly receive a window thereto;

a lift pulley mounted to the lift plate;

at least one cable;

a first and second guide pulleys respectively mounted near first and second ends of the rail; and a crank assembly;

wherein the at least one cable has a first end anchored near the first end of the rail and wound about the lift pulley and thence routed about the first guide pulley to operatively engage the crank assembly, and a second end anchored near the second end of the rail end wound about the lift pulley and thence routed about the second guide pulley to operatively engage the crank assembly, whereby operative movement of the crank assembly in a first sense tensions the at least one cable to move the lift plate towards the first end of the rail, and operative movement of the crank assembly in a second sense, opposite said first sense, tensions the at least one cable to move the lift plate towards the second end of the rail.

2. A window regulator assembly according to claim 1 wherein said at least one cable comprises a first cable having said first end and a second cable having said second end.

3. A window regulator assembly according to claim 2, wherein said crank assembly includes a drum and wherein said first and second cables are each windable around the drum.

4. A window regulator assembly according to claim 2, including means for tensioning said first and second cables.

5. A window regulator assembly according to claim 2, including additional guide pulleys, wherein said first cable is routed through the additional guide pulleys between said first guide pulley and said crank assembly and wherein said second cable is routed through the additional guide pulleys between said second guide pulley and said crank assembly.

6. A window regulator assembly according to claim 1, wherein said lift pulley is rotatably mounted to said lift plate.

7. A window regulator assembly according to claim 1, wherein said first and second guide pulleys are each rotatably mounted on said rail.

8. A window regulator assembly according to claim 2, wherein said lift pulley has at least two independent guides, each for guiding a respective one of said cables along a generally U-shaped route.

9. A window regulator assembly according to claim 1, wherein said lift plate includes a rail guide sliding along said rail.

10. A window regulator assembly according to claim 1, including means for maintaining tension on said at least one cable.

11. A window regulator assembly according to claim 1, wherein said crank assembly includes a drum and wherein said at least one cable is wound around the drum.

12. A window regulator assembly according to claim 1, including additional guide pulleys, wherein said at least one cable is routed through the additional guide pulleys between said first and second guide pulleys and said crank assembly.

13. A window regulator, comprising:

a rail;

a lift plate mounted to slide along the rail, the plate including means for attaching a window thereto;

a lift pulley rotatably mounted to the lift plate, the lift pulley having at least two independent guides; each for guiding a cable along a generally U-shaped route;

at least one cable;

at least first and second guide pulleys respectively rotatably mounted near first and second ends of the rail; and a crank assembly;

wherein the at least one cable has a first end anchored near the first end of the rail and wound around the lift pulley to the first guide pulley and thence routed to operatively engage the crank assembly, and a second end anchored near the second end of the rail and wound about the lift pulley to the second guide pulley and thence routed to operatively engage the crank assembly.

14. A window regulator, comprising:

a rail;

a lift plate mounted to slide along the rail, the plate including means for attaching a window thereto;

a lift-pulley rotatably mounted to the lift plate, the lift pulley having at least two independent guides, each for guiding a respective one of first and second cables along a respective generally U-shaped route;

first and second guide pulleys respectively rotatably mounted near first and second ends of the rail; and a crank assembly;

said first cable anchored near the first end of the rail and wound around the lift pulley to the first guide pulley and thence routed to operatively engage the crank assembly; and said second cable anchored near the second end of the rail and wound about the lift pulley to the second guide pulley and thence routed to operatively engage the crank assembly, whereby operative movement of the crank assembly in a first sense tensions one of the first and second cables to move the lift plate towards the first end of the rail, and operative movement of the crank assembly in a second sense, opposite said first sense, tensions the other of the first and second cables to move the lift plate towards the second end of the rail.

15. A window regulator according to claim 14, including additional guide pulleys, wherein said first cable is routed through the additional guide pulleys between said first guide pulley and said crank assembly and wherein said second cable is routed through the additional guide pulleys between said second guide pulley and said crank assembly.

* * * * *